United States Patent [19]

Fischer

[11] Patent Number: 4,491,070

[45] Date of Patent: Jan. 1, 1985

[54] ROTARY OFFSET PRINTING MACHINE HAVING A MULTI-IMAGE RECEIVING BLANKET CYLINDER

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 460,408

[22] Filed: Jan. 24, 1983

[30] Foreign Application Priority Data

Feb. 5, 1982 [DE] Fed. Rep. of Germany ..... 3203948

[51] Int. Cl.[3] ..... B41F 5/16

[52] U.S. Cl. ..... 101/181; 101/221

[58] Field of Search ..... 101/171, 177, 178, 181, 101/183, 211, 147, 232, 221

[56] References Cited

U.S. PATENT DOCUMENTS

| | | | |
|---|---|---|---|
| 3,263,606 | 8/1966 | Poynter | 101/181 X |
| 3,384,011 | 5/1968 | Schunemann | 101/183 X |
| 3,680,481 | 8/1972 | Sternberg | 101/232 |
| 3,902,415 | 9/1975 | Fischer | 101/177 X |
| 4,056,056 | 11/1977 | Giori | 101/177 |
| 4,154,165 | 5/1979 | Jeschke | 101/180 |
| 4,394,835 | 7/1983 | Gertsch et al. | 101/178 X |

FOREIGN PATENT DOCUMENTS

| | | | |
|---|---|---|---|
| 2421209 | 11/1974 | Fed. Rep. of Germany | 101/178 |
| 137558 | 9/1979 | German Democratic Rep. | 101/178 |
| 6705390 | 10/1967 | Netherlands | 101/177 |

*Primary Examiner*—E. H. Eickholt

*Attorney, Agent, or Firm*—Frishauf, Holtz, Goodman & Woodward

[57] ABSTRACT

To provide for multi-color printing while passing a substrate, such as cut sheets or a web (39, 67), only through a single printing line, so that paper, possibly of poor quality, will not be excessively saturated by damping liquid, and mechanically stressed by passage through a plurality of printing lines, the blanket cylinders (1–4; 30, 31; 50–53) of respective printing systems which each have plate cylinders, inkers and dampers, are positioned in ink and damping liquid transferring relation, so that a partial image to be printed, applied to a blanket cylinder (3, 31, 52) by a respective associated plate cylinder (7, 33, 56) is transferred to an adjacent contacting blanket cylinder (4, 30, 53) which, additionally, receives a second partial image to be printed from an associated respective plate cylinder (8, 32, 57). An impression or printing cylinder (17, 38, 66, 68) is provided, for contacting engagement of the printing substrate against the adjacent contacting blanket cylinder (4, 30, 53). Thus, the last blanket cylinder will carry a plurality of images, for example in different colors, and the substrate is contacted only at a single impression line with the last blanket cylinder. For versatility, the respective cylinders should be movably journalled, so that they can be rocked in and out of engagement with each other, to permit, respectively, printing in different modes by the same machine.

18 Claims, 4 Drawing Figures

To: 13, 14, 15, 16.
C
n
Paper Quality
Ink Quality
9
11
13
15
5
2
7
4
19
c
18
A
a
B
b
a
b
17
20
1
6
3
8
14
16
d
G
10
12

34
36
38
32
30
41
31
33
37
39
35
e
40

59
60
64
52
63
56
55
51
66
50
57
54
67
62
53
65
58
61

ROTARY OFFSET PRINTING MACHINE HAVING A MULTI-IMAGE RECEIVING BLANKET CYLINDER

Reference to related prior publications:
U.S. Pat. No. 2,894,452;
German Pat. No. 442,934;
German Pat. No. 2,323,871;
German Pat. No. 271,645.

Reference to related application, by the inventor hereof and assigned to the assignee of the present application: U.S. Ser. No. 06/460,498, filed Jan. 24, 1983, FISCHER.

The present invention relates to a rotary offset printing machine, which may be sheet-fed or web-fed, and having at least two rubber blanket cylinders and associated plate cylinders, inkers and dampers, to apply more than one subject matter to a single substrate, for example for multi-color printing.

BACKGROUND

Multi-color rotary offset printing machines are known; customarily, each color of ink is applied by a separate blanket cylinder on the substrate. Such machines, which are customary and standard in the printing field, have the disadvantage that a plurality of impression lines are needed for applying the ink of any one color to paper. Since offset rotary printing machines apply not only ink but also conduct damping liquid, typically water, to the substrate, typically paper, the paper is mechanically stressed since it becomes wetted by the damping liquid and then is passed through a plurality of printing lines where it is subjected to kneading. Such mechanical stressing of paper, particularly when the paper is of poor quality, leads to difficulties with respect to registration, which increases adjustment time of the machine and rejects. As the quality of paper decreases, each printing line, additionally, causes slight tearing or removal of paper particles from the paper substrate, leading to fuzzy printing and rapid soiling of the machine, requiring increased maintenance and cleaning thereof.

It has previously been proposed—see U.S. Pat. No. 2,894,452 and German Pat. No. 442,934—to provide a machine in which two differently colored inks can be printed simultaneously. Two plate cylinders are applied to a common blanket cylinder which then effects printing therefrom. Such arrangements have the disadvantage that set-up requires a long time, and for a substantial period it is not possible to obtain clear, sharp impression or printing. The disadvantage can be ameliorated to some extent by associating with each plate cylinder two dampers—see German Pat. No. 2,323,871, which, however, has the disadvantage that utilizing two dampers for each plate cylinder substantially increases the mechanical complexity of the printing machine, and introduces problems of accessibility to the respective components of the printing machine system. Additionally, the adjustment of the quantity of damping liquid applied by the respective dampers, and maintenance of relative adjustment of the two dampers with respect to each other, is complex and requires supervision.

It has also been proposed to provide an offset printing machine which can be used, selectively, for multi-color prime printing or prime and verso printing—see German Pat. No. 271,645. This printing machine utilizes a central printing or impression cylinder which is surrounded by a plurality of partial printing stations, each having a blanket cylinder, a plate cylinder, and associated dampers and inkers. Such a machine applies ink on the rubber blanket of the impression cylinder, for example from two partial printing systems, if prime and verso printing is to be carried out. The color inks are then printed simultaneously on the substrate. This arrangement, in order to apply two colors, requires three blanket cylinders. Both, when applying prime, as well as prime and verso printing, each one of the prime printing inks is applied by a blanket cylinder on the substrate, which cooperates with the common impression or printing cylinder. Consequently, problems with respect to registration cannot be excluded. The arrangement further presupposes that the partial printing systems are located about or around the central impression cylinder, which, in systems having a plurality of components, may lead to problems of accessibility. Such a machine cannot be readily expanded for different types of printing, for example in modular fashion, and the versatility thereof, therefore, is lessened.

THE INVENTION

It is an object to provide an offset rotary printing machine which permits multi-color printing on substrates without problems of registration, and which provides clear, sharp print for a long operating period; and which readily permits control of damping liquid to the printing systems of the printing machine, so that substrates, typically paper, of poor quality can be printed with superior printing results.

Briefly, the blanket cylinders of the respective printing systems are so positioned within the frame or structure of the machine that they are in ink and damping liquid transferring relation to each other, each transferring a partial image to an adjacent contacting blanket cylinder. Thus, a blanket cylinder, receiving printed subject matter from an associated plate cylinder, transfers this image, together with damping liquid, to an adjacent contacting blanket cylinder which, additionally, receives a second partial image to be printed from a respective associated plate cylinder. The substrate is passed about an impression or printing cylinder which is located to contact the last one of the blanket cylinders—if more than two are provided—and presses the substrate in engagement with the last one of the blanket cylinders. More than two such blanket cylinders, each transferring a partial image to an adjacent contacting printing cylinder, may be provided.

The system has the advantage of versatility, accessibility, and ready adjustment of ink as well as damping liquid which is being transferred, so that substrates, even if of poor quality, are not excessively stressed or kneaded in the printing process since the substrates are subjected only to a single printing or impression contacting line.

DRAWINGS

DETAILED DESCRIPTION

Figure 1:
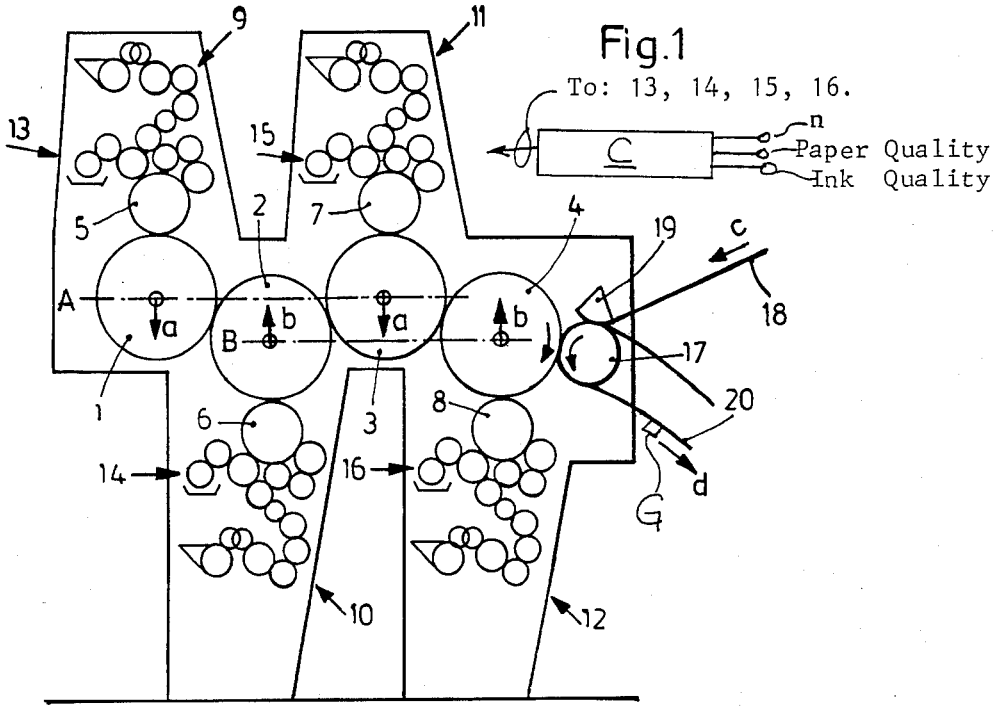
FIG. 1 is a schematic side view of the essential components of the printing machine, arranged for sheet printing.

The printing machine of FIG. 1 has four partial printing systems, each one having a blanket cylinder 1, 2, 3, 4, with which a respective plate cylinder 5, 6, 7, 8 is associated. Each plate cylinder has its own inker 9, 10, 11, 12 and damper 13, 14, 15, 16 associated therewith.

In accordance with a preferred construction and a feature of the invention, the diameters of the blanket cylinders 1–4 are a whole number multiple of the associated plate cylinders 5–8, preferably twice the diameter of the respective plate cylinders. This arrangement provides for good accessibility of the plate cylinders 5–8, the inkers 9–12, and the dampers 13–16, while still providing for compact machine construction. The axes of the blanket cylinders 1 and 3 are located in a first plane A, and the axes of the blanket cylinders 2 and 4 are located in the second plane B, spaced by a small vertical distance from the plane A, and parallel thereto. This arrangement permits easy adjustment of the engagement pressure of the respective blanket cylinders 1–4 with respect to each other by adjusting the position of the blanket cylinders 1 and 3, for example in the direction of the arrow a, or the blanket cylinders 2 and 4, respectively, for example in the direction of the arrow b.

Blanket cylinder 4, the last one in the series, in view of the direction of rotation as indicated by the arrow in blanket cylinder 4, cooperates with a printing or impression cylinder 17. Impression cylinder 17 has the same diameter as plate cylinders 5–8. Deflection sprockets are secured to the shaft of the impression cylinder 17 to guide a transport chain system 20 which is provided with grippers G, of which only one gripper is shown schematically. Substrate sheets are supplied from a make-ready table 18 in the direction of the arrow c by a transfer gripper system 19, and then gripped by the grippers G of the transport chain system 20. The sheets are guided by the transport chain system 20 partially about the printing cylinder 17, printing being effected by contact of the sheet at a single impression line against the blanket cylinder 4. The sheets are then transported to a delivery station—not shown—by the transport chain system 20.

Alternatively, the printing cylinder 17 may have grippers located thereon to receive sheets to be printed from the make-ready table 18 and the transfer grippers 19, and, in turn, transfer the sheets to any suitable transport and delivery arrangement. The transport and delivery systems may be constructed in accordance with any suitable and well-known construction.

Operation: As illustrated in FIG. 1, four-color prime printing can be carried out by engaging the blanket cylinders 1–4 with each other. Blanket cylinder 1 receives a partial image, for example in one color, from plate cylinder 5. Similarly, blanket cylinders 2, 3, 4 are inked by the associated plate cylinders 6, 7, 8 with respective partial-printed images in further colors, as desired. At the same time, blanket cylinder 1 transfers its partial image to the blanket cylinder 2 which, in turn, transfers both partial images to the blanket cylinder 3. Blanket cylinder 3 then transfers the two received partial images together with the partial image it received from its plate cylinder 7, this in three colors, to the blanket cylinder 4. Blanket cylinder 4 receives a further partial image from the associated plate cylinder 8. Printing is effected between the blanket cylinder 4 and the printing line defined by the printing or impression cylinder 17. Thus, four-color printing is effected along a single printing line on substrates, for example supplied by the supply grippers 19. The substrates are then removed by the transport chain system 20 in the direction of the arrow d to a delivery station.

The blanket cylinders 1–3 transfer not only ink between each other but, additionally, damping liquid. Accordingly, the dampers should be so adjusted that the quantity of damping liquid applied to the plate cylinders decreases from the damper 13, downstream in the direction of printed image transfer, so that the quantity of damping liquid supplied by damper 14 will be less than that of damper 13, damper 15 will supply still less damping liquid, and damper 16 the least. This basic adjustment can readily be effected by manual control or by an automatic control unit, schematically shown at C, and controlling adjustment of damping liquid supply based on the known characteristics of the respective dampers in well-known manner, for example in dependence on machine speed, paper quality—which can be manually set into the control unit C, subject matter to be printed, which, likewise, can be manually set into the control unit C, in accordance with well known relationships which take into consideration the characteristics of the paper being used, subject matter, inkers, dampers, and of the printing machine and the components thereof. Setting of respective inputs to the control unit C is shown schematically in FIG. 1 by the input terminals n receiving an input signal representative of machine speed, and input "paper quality" and "ink quality". Other inputs may be provided, as desirable.

The machine in accordance with the present invention has the advantage that it is capable of printing in four colors, and is arranged in serial, modular construction; a saving of three impression cylinders is effected, as well as apparatus to transfer a sheet from one printing system or printing station to another. An impression cylinder, further, is saved with respect to sheet offset printing machines having five cylinder stations, as well as means to transfer a sheet between printing stations. The number of printing or impression lines is sharply reduced with respect to known arrangements, so that difficulties in connection with registration are avoided, and, additionally, the substrate is handled much more gently, preventing tearing or picking of particles, fluff, and the like, from the paper.

The structure can readily be arranged in modular form, so that any number of printing statins can be combined, for example two, four—as shown—or more. The printing machine, thus, can be expanded to any desired maximum number of inks which are to be printed simultaneously. The printing stations can all be identical, except for the one which carries the printing or impression cylinder 17; this additional printing or impression cylinder can be associated with the printing station carrying the blanket cylinder from which subject matter is to be transferred as a separate structure, for example by way of an attachment to be placed on the frame holding the modular section which supports the printing system including the blanket cylinder 4.

Figure 2:
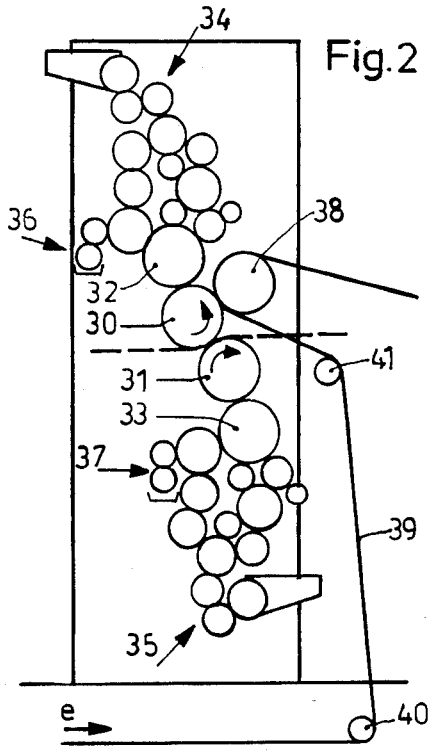
FIG. 2 is a side view of another embodiment, arranged for web printing.

Embodiment of FIG. 2: Two partial printing systems are shown, each having a respective blanket cylinder 30, 31, a plate cylinder 32, 33, and associated inkers and dampers 34, 35 and 36, 37. The blanket cylinder 30 has associated therewith a printing or impression cylinder 38. The embodiment of FIG. 2 is shown for printing on a web 39, which is supplied to the single impression or printing line between blanket cylinder 30 and printing cylinder 38 via suitable guide rollers 40, 41.

Operation: Plate cylinder 32 applies a first partial printing image in a first color to the blanket cylinder 30. Simultaneously, plate cylinder 33 applies a second partial image, in a second color, to the blanket cylinder 31 which, in turn, applies its partial image to the blanket cylinder 30. The two partial images, then, are applied to the substrate web 39 at a single impression or printing line. This printing line is defined by the tangential engagement zone between the blanket cylinder 30 and the printing cylinder 38, of course, with the substrate 39 interposed. The substrate 39, thus, will receive two-color prime printing at a single impression line.

The machine is highly versatile; it can be used for different forms of printing. For example, the substrate can be passed through the printing machine in the alternative path 39*a*, in which case the blanket cylinder 30 and the blanket cylinder 31, each, will apply, respectively, prime and verso printing with one color each. The direction of rotation of the respective cylinders need not be changed, so that, regardless of the type of printing to be obtained, that is, regardless of production requirements, no change in the overall set-up of the machine is necessary.

FIG. 2 illustrates a basic machine, which can readily be associated with similar further machines, arranged, for example, only to carry out a single prime and verso printing; alternatively, they may have printing cylinders 38 associated therewith, so that in the further printing stations, selectively, prime and verso printing, or two-color prime printing can be carried out. The further printing station can be physically located and arranged, for example as shown in FIG. 1, so that direct transfer of images from preceding—with respect to the web 39—blanket cylinders to the blanket cylinders 30, 31, respectively, is possible. If such an arrangement is used, it is desirable—for space reasons—to make the blanket cylinders larger than the plate cylinders, as shown in FIG. 1.

The system of FIG. 2 has the additional advantage of versatility; it can be constructed in the form of a well-known prime and verso printing system, which can be changed over to multi-color prime printing without requiring any changes in the printing system arrangement; it is only necessary to provide a location for bearings for the additional printing or impression cylinder 38 and, if necessary, a few guide rollers 40, 41 for proper web guidance.

Figure 3:
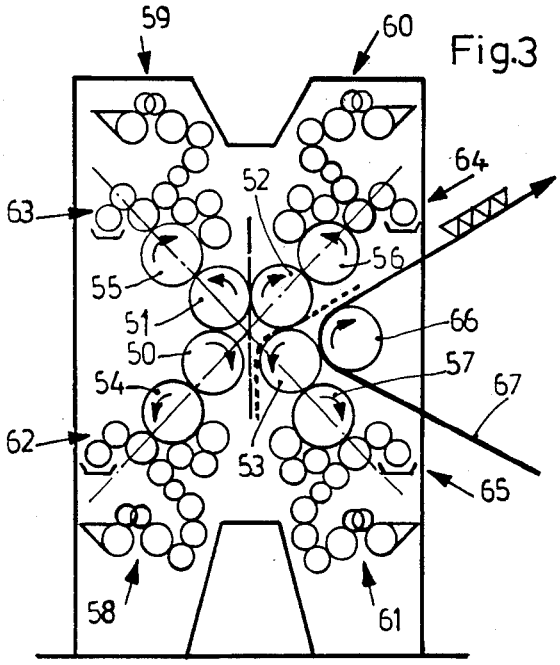
FIG. 3 is a schematic side view with four printing stations.

Embodiment of FIG. 3: Four printing systems are combined in a common frame structure to form a printing apparatus, having four blanket cylinders 50, 51, 52, 53, each having an associated plate cylinder 54, 55, 56, 57, an inker 58–61 and a damper 62–65. The axes of the plate cylinders 54–57 are so arranged that they are at the end points or along the lines of the legs of an X shown in FIG. 3 in chain-dotted line configuration. The axes of the blanket cylinders 50–53 are also located approximately on the legs of the X. Small deviations therefrom permit adjustment—which will be referred to below. A printing cylinder 66 is provided over which a printing substrate 67 is guided, and pressed against the blanket cylinder 53.

If the blanket cylinders 50–53 are adjusted as shown in FIG. 3, the blanket cylinder 50 is inked from the plate cylinder 54 to receive a partial image in a first color; blanket cylinder 51 receives a partial image in a second color from plate cylinder 55. The first partial image from blanket cylinder 50 and the second partial image from plate cylinder 55 are then transferred to the blanket cylinder 52 which, in turn, receives a third partial image, for example in a third color, from plate cylinder 56. Blanket cylinder 52 then transfers the three partial images to the blanket cylinder 53, which receives a fourth partial image, for example in a fourth color, from plate cylinder 57. The resulting four-color printed image can then be printed on the printing line which is formed by the blanket cylinder 53 with the printing or impression cylinder 66 on the web 67.

The apparatus of FIG. 3 is highly versatile and permits other printing arrangements. For example, the blanket cylinders 50 and 53 may be rotated about the center of the axes of the plate cylinders 54 and 57 until they touch. If, then, a printing substrate, for example a web or sheet of paper, is guided in form of the broken-line path, that is, straight up and down, two-color prime printing and two-color verso printing can be applied by transfer of one color from plate cylinder 54 to blanket cylinder 50, and from there to the blanket cylinder 51, which receives a second color from blanket cylinder 55. The verso printing is carried out by the mirror-image arrangement.

A further possibility is to guide a substrate along the dotted path, which then permits printing of three colors in prime printing, and one color, for example black, in verso printing. The complete prime and verso printing, again, will be along only a single printing or impression line, the blanket cylinder 53 acting, simultaneously, as a printing cylinder as well as the cylinder which transfers the image for the verso print.

If the web is guided in the direction of the broken-line configuration, that is, straight up and down between the blanket cylinders 51 and 52, which provide a single printing line, or in the dotted-line position, that is, with the substrate between blanket cylinders 52, 53, the impression cylinder 66 should be rocked or otherwise moved out of engagement from the blanket cylinder 53.

The position or path of the web need not be vertical, as shown; it could easily also be guided horizontally between the blanket cylinders 50 and 51, as well as 53 and 52, or at least one of them, to apply at least one printed image in both prime and verso printing. The impression cylinder 66 should then also be disconnected, and the web guided so as not to interfere with its position. The cylinders 50, 51, then, preferably are separated and do not apply any printed image, so that only a single-color prime and verso printing is effected.

Figure 4:
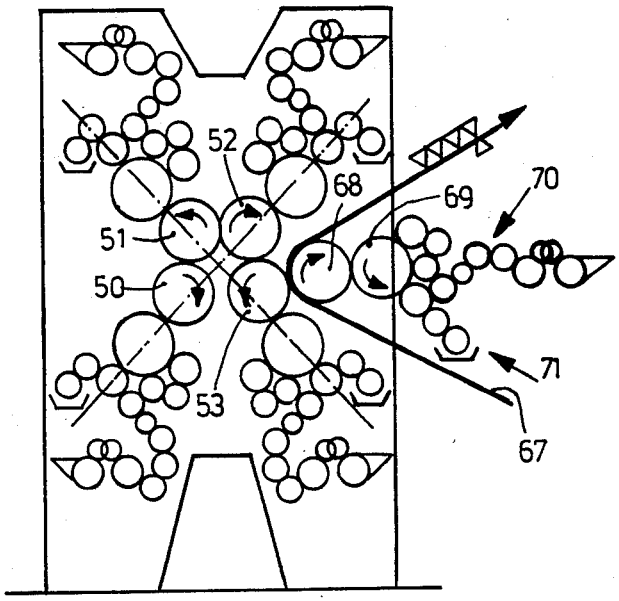
FIG. 4 illustrates the arrangement of FIG. 3 with an additional printing system to apply additional verso printing.

Embodiment of FIG. 4: The basic configuration of FIG. 4 is identical to that of FIG. 4. Four blanket cylinders 50–53 are used. In addition to the printing systems of FIG. 3, a fifth printing system is provided in which a blanket cylinder 68 is used as a combination printing and impression cylinder for the blanket cylinders 50–53 or, more accurately, for the last blanket cylinder 53 to form a single printing or impression line therewith. Additionally, the blanket cylinder 68 transfers an image to the reverse side of the substrate carrier 67 from a plate cylinder 69, which is inked by an inker 70 and damped by a damper 71. The system 68–71 thus forms a fifth partial printing system.

If the cylinders are in the position shown in FIG. 4, the web 67, as described in connection with FIG. 3, receives four-color images on the prime side; in addition to the printing, as described in connection with FIG. 3, a further image in the ink selected for the reverse side is applied by the printing system 69–71 and the blanket cylinder 68 which forms the image transferring cylinder for the web 67 for the verso print and the impression or printing cylinder for the prime printing, the blanket cylinder 53 forming the impression or printing cylinder for the blanket cylinder 68. Again, printing is effected at only a single printing line.

Various changes and modifications may be made within the scope of the inventive concept, and features described in connection with any one of the embodiments may be used with any of the others, within the scope of the inventive concept. Different arrangements may be made, and different sheet or web guidance arrangements may be used. For example, the printing system of FIG. 1 may be used to print on an endless web, rather than on cut sheets. The web then must be guided between cylinders 4 and 17, and the sheet-feeding apparatus omitted. The apparatus of FIGS. 2, 3 or 4 may also be used to print on cut sheets. If so, the printing cylinder would have to be of the type which includes grippers. Sheet supply and removal apparatus would then also be required, for example as described in connection with FIG. 1. Any other structure, for example sheet feeding and removal apparatus well known in the industry, may also be used.

I claim:

1. Rotary offset printing machine system having at least two printing systems, each including a rubber blanket cylinder (1–4; 30, 31; 50–53);

a plate cylinder (5–8; 32, 33; 54–57), an inker (9–12; 34, 35; 58, 61) and a damper (13–16; 36, 37; 62–65), and wherein, in accordance with the invention, the blanket cylinder (e.g. 3, 31, 52) of any one of the respective systems is positioned in ink and damping liquid transferring relation with the blanket cylinder (4) of an adjacent system to transfer a partial image to be printed applied to the one blanket cylinder (3, 31, 52) by a respectively associated plate cylinder (7, 33, 56) to the adjacent, contacting blanket cylinder (4, 30, 53) of the adjacent system, which adjacent blanket cylinder additionally receives a second partial image to be printed from a respectively associated plate cylinder (8, 32, 57) so that said one blanket cylinder (3) will operate as an image transfer cylinder to the adjacent blanket cylinder (4);

and an impression or printing cylinder (17, 38, 66, 68) is provided for contacting engagement of a printing substrate (39, 67) against said adjacent contacting blanket cylinder (4, 30, 53).

2. Printing machine system according to claim 1, wherein the diameter of the blanket cylinders (1–4) is a whole number multiple of the diameter of the associated plate cylinder (5–8).

3. Printing machine system according to claim 2, wherein the diameter of the blanket cylinder (1–4) is twice the diameter of the associated plate cylinder (5–8).

4. Printing machine system according to claim 1, wherein the plate cylinder (5, 7), the inker (9, 11) and the damper (13–15) of one printing system is located above the respectively associated blanket cylinder (1, 3), and the plate cylinder (6, 8), the inker (10, 12) and the damper (14, 16) of an adjacent printing system is located below the associated blanket cylinder (2, 4).

5. Printing machine system according to claim 1, wherein more than two printing systems are provided, located adjacent each other and vertically staggered and so arranged that the axes of the blanket cylinders (1–4) are, alternatingly, positioned in one of two parallel planes (A, B).

6. Printing machine system according to claim 1, wherein four printing systems are provided, and the axes of rotation of the plate cylinders (54–57) as well as the axes of rotation of the associated rubber blanket cylinders (50–53) are located, approximately, on connecting lines forming an X;

and wherein the blanket cylinders (50–53) are journalled for movement of the respective axes of rotation thereof in are arc about the axis of rotation of the associated plate cylinder.

7. Printing machine system according to claim 1, wherein the impression or printing cylinder (17, 38, 66) is movable out of contacting engagement with the blanket cylinder (30, 53) positioned adjacent thereto.

8. Printing machine system according to claim 1, wherein the printing or impression cylinder (68) comprises a rubber blanket cylinder;

and an additional printing system including a plate cylinder (69), an inker and a damper (70, 71) is associated with said blanket cylinder forming the impression cylinder for the adjacent blanket cylinder (53).

9. Printing machine system according to claim 1, wherein the printing machine is a sheet-fed machine;

and wherein a chain gripper system (20) is provided, rotationally guided about the axis of rotation of the impression or printing cylinder (17).

10. Printing machine system according to claim 1, further including damping liquid control means (C) controlling damping liquid application from the dampers in a direction to reduce the amount of damping liquid applied from the dampers associated with printing systems closer to the impression cylinder with respect to those farther from the impression cylinder, in the path of image transfer.

11. Printing machine system according to claim 1, wherein the printing stations are constructed in the form of modules, and the machine comprises a plurality of essentially identical modules.

12. Printing machine system according to claim 4, the diameter of the blanket cylinders (1–4) is a whole number multiple of the diameter of the associated plate cylinder (5–8).

13. Printing machine system according to claim 12, wherein the diameter of the blanket cylinder (1–4) is twice the diameter of the associated plate cylinder (5–8).

14. Printing machine system according to claim 5, wherein the diameter of the blanket cylinders (1–4) is a whole number multiple of the diameter of the associated plate cylinder (5–8).

15. Printing machine system according to claim 14, wherein the diameter of the blanket cylinder (1–4) is twice the diameter of the associated plate cylinder (5–8).

16. Printing machine system according to claim 12, wherein more than two printing systems are provided, located adjacent each other and vertically staggered and so arranged that the axes of the blanket cylinders (1–4) are, alternatingly, positioned in one of two parallel planes (A, B).

17. Printing machine system according to claim 13, wherein more than two printing systems are provided, located adjacent each other and vertically staggered and so arranged that the axes of the blanket cylinders (1–4) are, alternatingly, positioned in one of two parallel planes (A, B).

18. Printing machine system according to claim 6, wherein the printing or impression cylinder (68) comprises a rubber blanket cylinder;

and an additional printing system including a plate cylinder (69), an inker and a damper (70, 71) is associated with said blanket cylinder forming the impression cylinder for the adjacent blanket cylinder (53).

* * * * *